United States Patent [19]

Zagorski

[11] 4,155,359

[45] May 22, 1979

[54] AIR FILTERING MASK

[76] Inventor: Antoni Zagorski, 9431 Julie Beth St., Cypress, Calif. 90630

[21] Appl. No.: 799,503

[22] Filed: May 23, 1977

[51] Int. Cl.[2] ..... A62B 7/10

[52] U.S. Cl. ..... 128/146.6; 128/142.6; 55/432; 55/459 R

[58] Field of Search ..... 128/146.6, 146.5, 146.4, 128/146.3, 146 R, 142.2, 142.3, 142.4, 142.6, 266, 208, 205; 55/459 R, 430, 432, 419

[56] References Cited

U.S. PATENT DOCUMENTS

| | | | |
|---|---|---|---|
| 2,332,662 | 10/1943 | Nathanson | 128/142.6 X |
| 3,541,764 | 11/1970 | Astrom | 55/432 X |
| 3,807,400 | 4/1974 | Cocozza | 128/208 X |
| 4,038,051 | 7/1977 | Ide | 55/432 X |

*Primary Examiner*—Henry J. Recla
*Attorney, Agent, or Firm*—Raymond L. Madsen

[57] ABSTRACT

There is disclosed an air filtering mask having a cyclone filter member attached to a mask body, the cyclone filter member including a hollow slotted cylinder section attached to the base end of a hollow frusto-conical section and a hollow vortex finder having a substantially cylindrical body and two ends, one end being radially connected and sealed to the interior wall of the hollow cylinder section and the other end being located within the base end of the hollow frusto-conical section, the cylindrical body of the vortex finder extending coaxially through and being uniformly spaced from the interior wall of the hollow cylinder section, the hollow cylinder section having a multiplicity of slots through the walls thereof, the multiplicity of slots being aligned to penetrate into the region between the hollow vortex finder and the hollow slotted cylinder section tangential to the interior wall of the hollow cylinder section, the frusto-conical section having an opening in the apex end thereof. The mask body has an exterior and interior, the interior being constructed and arranged to be worn over the nose and mouth of the wearer of the mask, and has an opening therethrough into which the hollow slotted cylinder section is attached, the multiplicity of slots being located exterior to the mask body whereby air enters into the slots and tangentially spirals through the cylinder section adjacent the interior wall thereof into the frusto-conical section such that particles contained in the air are centrifugally impinged against the interior surface of the frusto-conical section and forced out the opening in the apex end thereof, the tangentially spiralling air forming a central vortex of clean air, which is intercepted and transmitted into the mask body by the vortex finder when the wearer inhales thereby filtering the air.

5 Claims, 6 Drawing Figures

AIR FILTERING MASK

The present invention relates to air filtering devices and more particularly to face mask cyclone filters.

In the field of face mask filters, it has been the general practice to employ a filter base or membrane of felted or fibrous materials and labrynith plates or baffles which may be coated with greases or adhesive substances to remove particulate matter from the air. One such filter mask is described in U.S. Pat. No. 2,261,362 granted to Franklin E. Gill. Although such devices have served the purpose, they have not proved entirely satisfactory under all conditions of service for the reasons that considerable difficulty has been experienced in obtaining a filter capable of efficiently removing unwanted particulate matter from the air in conjunction with a low resistance to breathing and difficulties encountered in the filter membranes and the coated baffle plates becoming impregnated and saturated with particles and material filtered from the air to the extent they are inoperable as a filter.

Those concerned with the development of face mask filters have long recognized the need for a non-replaceable self-cleaning filter. The present invention fulfills this need.

The general purpose of this invention is to provide a face mask filter which embraces all the advantages of similarly employed filtering masks and possesses none of the aforedescribed disadvantages. To attain this, the present invention contemplates a unique combination of a cyclone separator filter in connection with a face mask whereby filter saturation and clogging along with high breathing resistance are avoided.

An object of the present invention is the provision of a non-replaceable filter mask which is self-cleaning and non-clogging.

Another object is to provide a face mask filter which is non-clogging and self-cleaning and which possesses a high efficiency of filtering and low resistance to breathing.

A further object of the invention is the provision of a face mask filter which requires no filter base or membrane.

Other objects and many of the attendant advantages of this invention will be readily appreciated as the same becomes better understood by reference to the following detailed description when considered in connection with the accompanying drawings in which like reference numerals designate like parts throughout the figures thereof and wherein.

Figure 1:
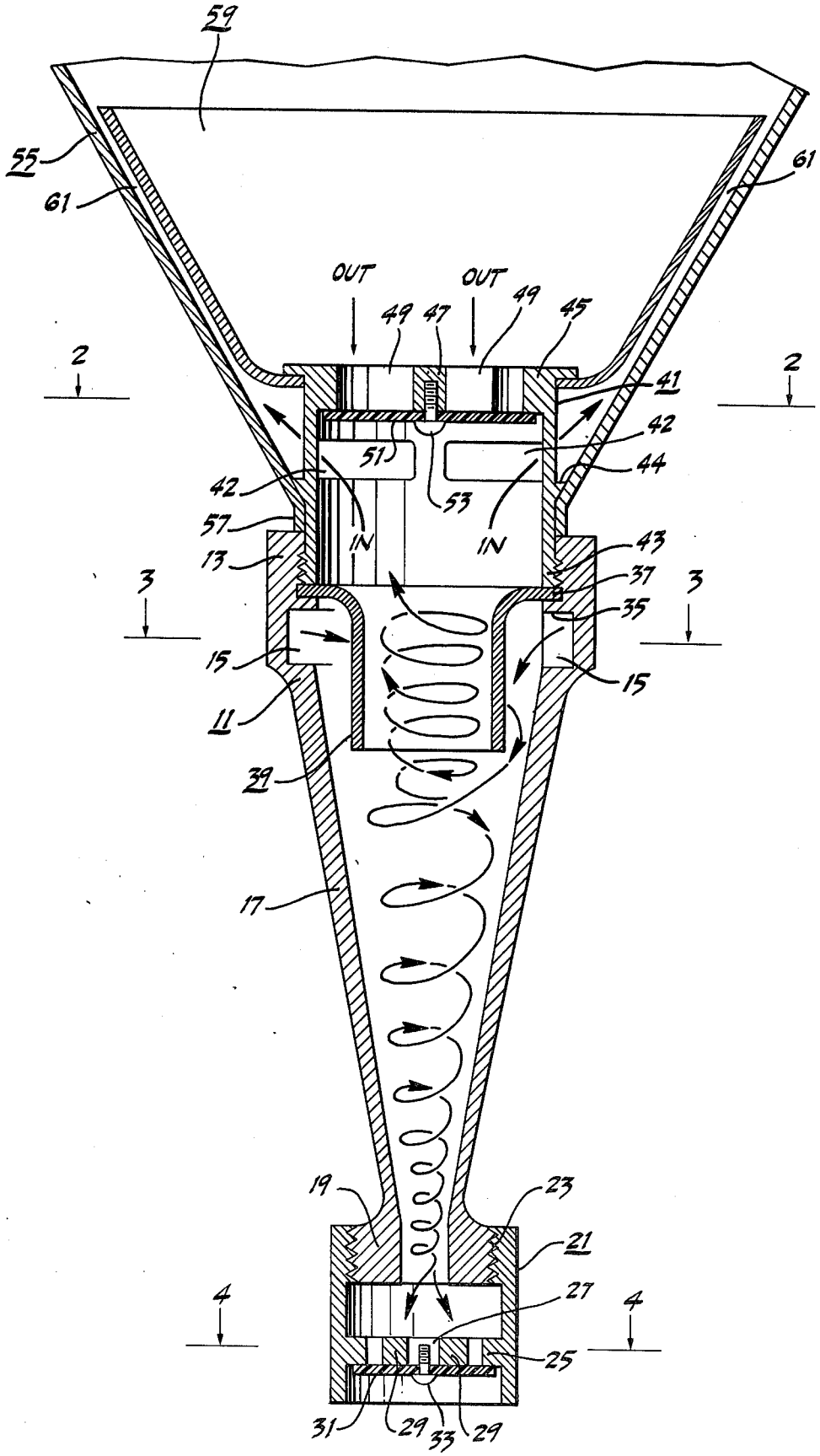
FIG. 1 shows a cross section, partly cut away, of a preferred embodiment of the invention.

Referring now to the drawings wherein like reference characters designate like or corresponding parts throughout the several views, there is shown in FIG. 1 (which illustrates a preferred embodiment) a cyclone separator filter 11 having a hollow slotted cylinder section 13 at one end thereof with a plurality of slots 15 therethrough, slots 15 being tangential to the interior surface of hollow slotted cylinder section 13. A frusto-conical section 17 has the base end thereof integrally connected to hollow slotted cylinder section 13 and an open apex end 19 thereof threadably connected by threads 23 to one end of a check valve assembly 21. Check valve assembly 21 is cylindrical in shape and is hollow with an interior circular lip 25 therearound adjacent the other end thereof to which are attached radial ribs 29 which in turn are centrally connected to a center section 27 having a threaded hole therein adapted to receive a screw. A flexible disc or valve 31 flexibly mates with lip 25 and is centrally secured to center section 27 by a screw 33 passing through the center of disc 31 and threadably engaging center section 27.

Hollow slotted cylinder section 13 has a shoulder 35 therearound upon which a radial collar or radially flanged end 37 of a hollow vortex finder 39 is attached and sealed. Hollow vortex finder 39 has a hollow cylindrical body which extends coaxially through and is uniformly spaced from the interior wall of cylinder section 13 with the unconnected end thereof being located within the base end of hollow frusto-conical section 17. A cylindrical section 41 is threadably engaged with the interior wall of hollow slotted cylinder section 13 by a threaded surface 43 at the end thereof oppositely disposed from the frusto-conical section 17. The other end of cylindrical section 41 has a lip 45 circumferentially located along the interior surface thereof to which lip radial supports 49 are attached and in turn are connected to a centrally located center section 47 having a threaded hole therein adapted to receive a screw. A flexible disc or diaphragm valve 51 is fixedly secured against lip 45 and radial support arms 49 by a threaded screw 53 passing centrally through the center of valve 51 and threadably engaging center section 47. A multiplicity of openings 42 pass through the walls of cylindrical section 41 adjacent circular lip 45. A mask body 55 is attached to the outer surface of cylindrical section 41 by a circular lip 57 thereof which extends circumferentially around the circumference of cylindrical section 41 and mates with and is sealed to a circumferential shoulder 44 around cylindrical section 41. Lip 57 forms a circular opening in mask body 55 into which cylindrical section 41 is sealed.

The other end of cylindrical section 41 adjacent lip 45 has cup-shaped member 59 having a circular opening therein into which the end of cylindrical section 41 is sealed or securely attached. Cylindrical section 41 spacially supports cup-shaped member 59 adjacent the interior of mask body 55 leaving a circular space 61 between cup-shaped member 59 and mask body 55. Openings 42 in cylindrical section 41 communicate between the interior of cylindrical section 41 and space 61.

Figure 2:
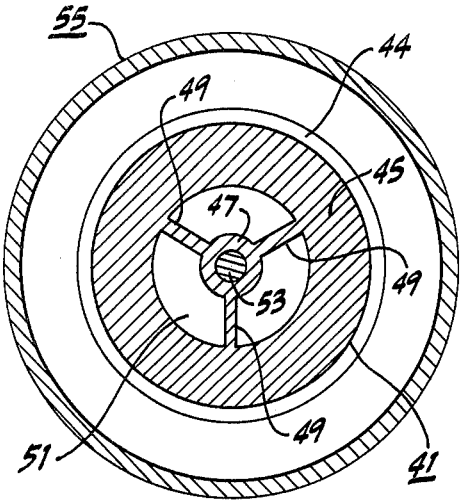
FIG. 2 illustrates a section of the device taken on line 2—2 of FIG. 1, looking in the direction of the arrows.

Turning now to FIG. 2, there is illustrated a section of the device of FIG. 1 taken on line 2—2, looking in the direction of the arrows, showing mask body 55 funneling down and connecting with hollow cylinder section 41 underneath lip 44. Interior lip 45 has radial support arms 49 extending therefrom and connecting with tapped and threaded center section 47 into which screw 53 is threadably engaged securing check valve diaphram 51 thereto.

Figure 3:
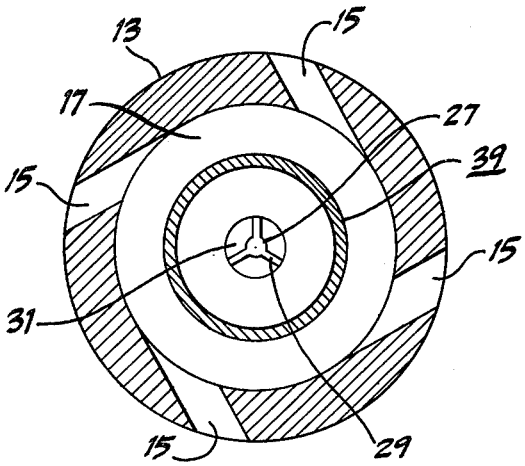
FIG. 3 shows a section of the device taken on the line 3—3 of FIG. 1, looking in the direction of the arrows.

FIG. 3 illustrates a section of the device shown in FIG. 1, taken on the line 3—3 in the direction of the arrows with slots 15 penetrating the walls of cylinder section 13 and entering the interior of cylinder section 13 tangential to the interior surface thereof. Vortex finder 39 is shown coaxially located and spaced within slotted cylinder section 13. The interior surface of frusto-conical section 17 funnels down into the opening in the apex thereof through which radial supports 29 connected to tapped and threaded center section 27 and check valve disc 31 are observable.

Figure 4:
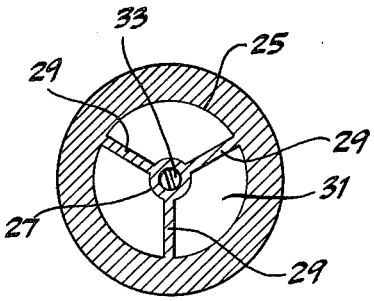
FIG. 4 illustrates a section of the device taken on the line 4—4 of FIG. 1, looking in the direction of the arrows.

In FIG. 4 there is illustrated a section of the device of FIG. 1, taken on the line 4—4, looking in the direction of the arrows, in which radial support arms 29 connected to lip 25 and centrally connected to tapped and threaded center section 27 are shown along with screw 33 threaded in center section 27 centrally attaching check valve disc 31 thereto.

Figure 5:
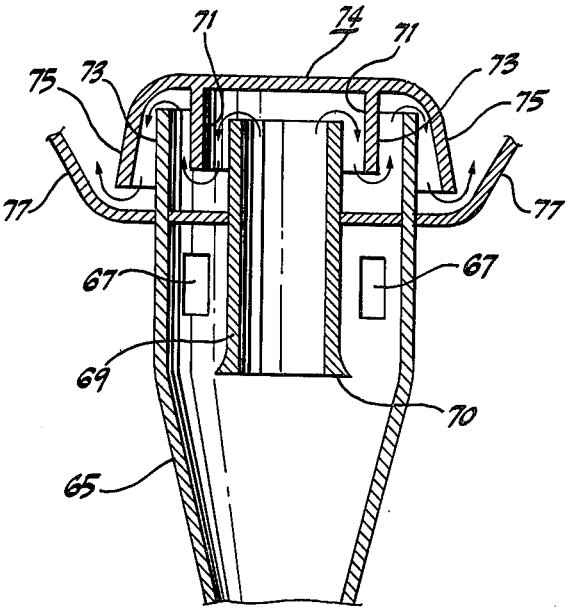
FIG. 5 illustrates a cross-section partly cut away of an alternate embodiment of the invention.

Turning now to FIG. 5, there is illustrated a cross section of an alternate embodiment of the invention having a frusto-conical section 65 integrally connected to a cylinder section 73 in which slots 67 pass therethrough into the interior surface of cylinder section 73 in a manner similar to slots 15 in FIG. 1. A vortex finder 69 having a cylindrical shape is attached and sealed by a radial collar to the interior of cylinder section 73 with one end thereof, having a flanged lip or edge 70, extending into the base of frusto-conical section 65. A mask body 77 is circumferentially attached to the exterior surface of cylinder section 73 the walls of which extend into the interior of mask body 77. A cup 74 with walls 75 thereon is spacially placed over and spaced from the walls of cylinder section 73 so as to be coaxially positioned therein. Another coaxial cylindrical member 71 is mounted upon cup 41 and is spaced interior to the walls of cylinder section 73 and exterior to the walls of vortex finder 69 which extends into and is uniformly spaced from the interior of coaxial cylindrical member 71. The coaxially spaced walls of vortex finder 69, cylindrical member 71 and cylinder section 73 along with walls 75 of cup 74 form a series of baffle plates or a labyrinth of coaxial cylindrical members for providing a tortuous passageway from the interior of vortex finder 69 radially outward to the interior of mask body 77.

Figure 6:
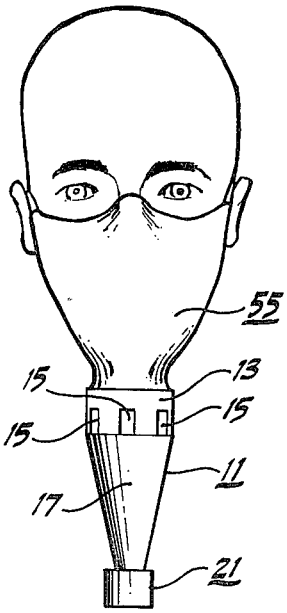
FIG. 6 illustrates a pictorial view of the invention in operating position on the wearer.

In FIG. 6 there is shown a front pictorial view of the invention, FIG. 1 in place upon the face of a wearer. Mask body 55 is placed over the nose and mouth of the wearer and is attached to cylinder section 13 with slots 15 therethrough, cylinder section 13 in turn being attached to the base of frusto-conical section 17 which in turn has the apex thereof attached to check valve assembly 21.

Operation of the preferred embodiment of the invention can best be described by reference to FIG. 1. There are two main operational cycles, the first being when the wearer of the filter mask inhales during which inspired or inhaled air is filtered through the mask and the second being when the wearer expires or exhales. When the mask wearer inhales, check valve diaphram 51 is pulled tightly against lip 45 and radial arms 49 to close off the opening between radial arms 49 and lip 45 of cylindrical section 41. Similarly, check valve disc or diaphram 31 is pulled tightly against lip 25 and radial arms 29 of check valve assembly 21 to close off the opening therein between radial arms 29 and lip 25. Upon inspiration, unfiltered air enters through slots 15 in cylinder section 13 tangential to the interior surface thereof, causing the air to swirl circularly within circular cylindrical section 13 and to spiral downwardly into frusto-conical section 17 as indicated by the arrows spiralling downward wherein the particulate matter contained in the air is centrifugally impinged against the interior surface of frusto-conical section 17 and forced through the apex opening therein into the interior of check valve assembly 21 where the particulate matter is collected on the surface of check valve disc 31 and the interior surfaces of check valve assembly 21. The incoming air spiralling downward adjacent the interior surface of frusto-conical section 17 is accompanied by a central vortex of upward spiralling air cleansed of particulate matter which is intercepted by vortex finder 39 and directed therethrough into the interior of cylindrical section 41 as indicated by the arrows spiralling upward. Since check valve disc 51 prevents air from entering through the opening between radial supports 49 and lip 45, the cleansed air spirals outwardly through openings 42 in cylinder section 41 into space 61 between mask body 55 and cup-shaped member 59. Any particulate matter left in the air flowing in space 61 is settled out on the interior surface of mask body 51 and cup-shaped member 59 as the air traverses the elongated path of space 61 therebetween. Mask body 55 and cup-shaped member 59 may have an adhesive coating such as grease or vasoline thereon to which particulate matter may adhere as the air passes through space 61 into the interior of mass body 55.

Therefore, in the first phase of operation upon the wearer inspiring or inhaling, there are two filtering actions provided by the mask. The first is the separation of particulate matter from the incoming air entering slots 15 by the cyclone or circular motion of the air within frusto-conical section 17 and the second filtering action being provided by the air progressing through space 61 between the cup-shaped member 59 and the interior of mask body 55.

In the second phase of operation, upon the exhaling or expiration of the wearer, air leaving the nose or mouth of the wearer enters through the openings between radial members 49 and lip 45 past check valve disc 51 which is forced outwardly away from lip 45 by the force of the exhaling breath of the wearer and then into the interior of cylinder section 41. The exhaled air is prevented from exiting outwardly through openings 42 in cylinder section 41 by the positive pressure of the exhaled breath of the wearer which is also present in space 61 between cup-shaped member 59 and mask body 55. Therefore, the exhaled breath continues through cylinder section 41 and vortex finder 39 and frusto-conical section 17 into check valve assembly 21. The positive pressure of the exhaled breath forces check valve disc 31 away from lip 25 of check valve assembly 21 allowing the exhaled breath to exit between radial members 29 and lip 25 past check valve disc 31 into the exterior environment of the mask assembly. As the exhaled breath traverses check valve assembly 21, it dislodges particulate matter collected therein during the inhaling cycle of operation and forces such matter into the exterior environment of the mask. Therefore, the cyclone filter portion of the mask is self-cleaning upon each exhaled breath of the wearer.

It should be noted that there is very little breathing resistance offered by the cyclone mask filter described by the present invention. There are no small orifices or filter membranes through which the air must pass and therefore, the restriction to air flow upon inspiration or inhaling is minimal. Consequently, the wearer of the filter mask experiences very little difficulty in breathing. This result should be quite evident by noting that the size of slot openings 15 are of sufficient magnitude to prevent very little restriction to air flow in conjunction with the large opening of the vortex finder and openings 42 in cylinder section 44 into the interior of mask body 55. Although space 61 is elongated and can be quite narrow by the placement of cup-shaped member 59 close to mask body 55, the circular shape of cup-shaped member 59 adjacent the interior of mask body 55 provides a circumferential opening therebetween which offers very little restriction to the flow of air.

Similarly, upon expiration or exhaling, the wearer experiences very little resistance to the outward flow of air as it passes by flexible check valve disc 51, through the interior of the cyclone filter assembly and outward from check valve assembly 21 past flexible check valve disc 31 into the outside environment.

It should be noted that check valve disc 51 and 31 can be made of very flexible, soft, pliable material such as thin rubber and the like to provide very little resistance to the exhale flow of air from the wearer.

Operation of the alternate embodiment of the invention illustrated in FIG. 5 utilizes the same cyclone separating action as discussed above in respect to FIG. 1. However, as the air exits from vortex finder 69 and traverses in the direction of the arrows through the tortuous labyrinth path between the vortex finder, cylindrical member 71 and the walls of cylinder section 73 and walls 75 of cup-shaped member 74 into the interior of mask body 77, more resistance is experienced to the flow of air than the preferred embodiment illustrated in FIG. 1. It should be further noted that the walls of cylindrical member 71 and cylinder section 73 along with wall 75 of cup-shaped member 74 can be coated with vasoline or grease or a similar adhesive to collect particulate matter which may still be contained in the air after having traversed the cyclone separating portion of the filter mask.

Mask body 55 and 77 may be constructed from any flexible air-tight material such as rubberized fabric and the like. All of the other elements of the mask filter in both the embodiments of FIG. 1 and FIG. 5 may be constructed of metal such as aluminum or molded plastic and the like.

It now should be apparent that the present invention provides a cyclone filter assembly which may be employed in conjunction with a face mask for removing unwanted particulate matter from air inspired or inhaled by the wearer of the mask such that very little breathing resistance is offered to the wearer and the collected particulate matter is cleansed from the cyclone filter upon expiration or exhaling of the mask wearer.

Although particular components, etc., have been discussed in connection with a specific embodiment of a filter mask constructed in accordance with the teachings of the present invention, others may be utilized. Furthermore, it will be understood that although exemplary embodiments of the present invention have been disclosed and discussed, other applications and mechanical arrangements are possible and that the embodiments disclosed may be subjected to various changes, modifications and substitutions without necessarily departing from the spirit of the invention.

What is claimed is:

1. An air filtering mask comprising:

a cyclone filter member including, a hollow slotted cylinder section, a hollow frusto-conical section the base end of which is attached to said hollow slotted cylinder section, and a hollow vortex finder having a cylindrical body with a radial collar therearound connected and sealed to the interior wall of said cylinder section, said cylindrical body of said vortex finder extending coaxially through and being uniformly spaced from said interior wall of said cylinder section, said hollow slotted cylinder section having a multiplicity of slots therethrough tangential to said interior wall of said hollow slotted cylinder section, said multiplicity of slots being aligned to penetrate into the region between said hollow vortex finder and said interior wall of said hollow slotted cylinder section, said frusto-conical section having a closed apex end; and a mask body having an exterior and interior, said interior being constructed and adapted to be worn over and cover the nose and mouth of a wearer of the mask, said mask body having an opening therein in which said hollow slotted cylinder section is attached, said multiplicity of slots being located exterior to said mask body whereby air enters through said slots and tangentially spirals through said cylinder section adjacent said interior wall thereof into said frusto-conical section such that the particles contained in the air are centrifugally impinged against the interior surface of said frusto-conical section and collected at said apex end thereof, the tangentially spiralling air forming a central vortex of clean air which is intercepted and transmitted into said mask body by said vortex finder when the wearer inhales, thereby filtering the air.

2. The air filtering mask described in claim 1 further including check valve means mounted in said apex end of said frusto-conical section, said check valve means allowing air and particles to exit from said apex end when the wearer exhales and preventing air from entering said apex end when the wearer inhales.

3. The air filtering mask described in claim 2 further including:

a cup-shaped member spacially mounted adjacent said interior of said mask body thereto and centrally located over said opening therein, said cup-shaped member having an opening aligned with said opening in said mask body;

means for spacially mounting said cup-shaped member interior to said mask body; and second check valve means mounted in said opening of said cup-shaped member, said second check valve closing when the wearer inhales and opening when the wearer exhales whereby filtered air transmitted into said mask body from said vortex finder passes through the space between said cup-shaped member and said mask body thereby further filtering the air when the wearer inhales and air is transmitted from the wearer through said second check valve and said cyclone filter member and said first valve when the wearer exhales.

4. The air filter mask described in claim 3 wherein said means for spacially mounting said cup-shaped member within said mask body is a second hollow cylinder section having openings through the walls thereof and being connected between and mating with said opening in said mask body and said opening in said cup-shaped member.

5. The air filtering mask described in claim 1 further including a plurality of overlapping coaxial circular members of different diameters constructed and arranged as baffling means for providing a tortuous passageway from the center thereof radially outward, the innermost of said circular members being said end of said vortex finder whereby filtered air exiting from said vortex finder is further filtered by said tortuous radial passageway before entering the interior of said mask body.

* * * * *